United States Patent [19]

Krekel

[11] 4,032,612

[45] June 28, 1977

[54] METHOD AND A DEVICE FOR PRODUCING A PLATE-LIKE STRUCTURAL ELEMENT

[76] Inventor: Hendrik Krekel, Dillenburgstraat 93, Breda, Netherlands

[22] Filed: May 20, 1974

[21] Appl. No.: 471,298

[30] Foreign Application Priority Data

May 21, 1973 Netherlands ..... 7307077

[52] U.S. Cl. ..... 264/259; 264/257; 264/261; 264/263; 264/308; 264/323; 264/333; 264/336

[51] Int. Cl.[2] ..... B28B 13/05

[58] Field of Search ..... 264/228, 256, 261, 323, 264/334, 336, 229, 297, 257, 263, 308, 333; 425/455; 249/66 R

[56] References Cited

UNITED STATES PATENTS

| | | | |
|---|---|---|---|
| 1,315,733 | 9/1919 | Massey | 264/334 |
| 2,663,063 | 12/1953 | Van Loon | 264/334 |
| 2,971,239 | 2/1961 | Schaich | 264/157 |
| 3,640,658 | 2/1972 | Price | 249/137 X |
| 3,785,608 | 1/1974 | Heinzman | 264/DIG. 57 |

FOREIGN PATENTS OR APPLICATIONS 681,354 10/1952 United Kingdom

*Primary Examiner*—Thomas P. Pavelko

[57] ABSTRACT

This invention relates to a method and apparatus for forming wall panel boards from paste-like material. The mould is pivotable between a horizontal and vertical position. The paste-like material and reinforcements are placed in the mould when it is in the horizontal position. The mould is then pivoted to the vertical position such that the yet non-hardened board may be pulled vertically upwards out of the mould. The cross-sectional dimension of the board is shaped by the upper opening of the mould as the former is being pulled out. The board is suspended for hardening outside of the mould, while the mould is returned to the horizontal position for moulding the next board. Thus, the mould can be continuously used without having to wait for the board to harden therein.

5 Claims, 1 Drawing Figure

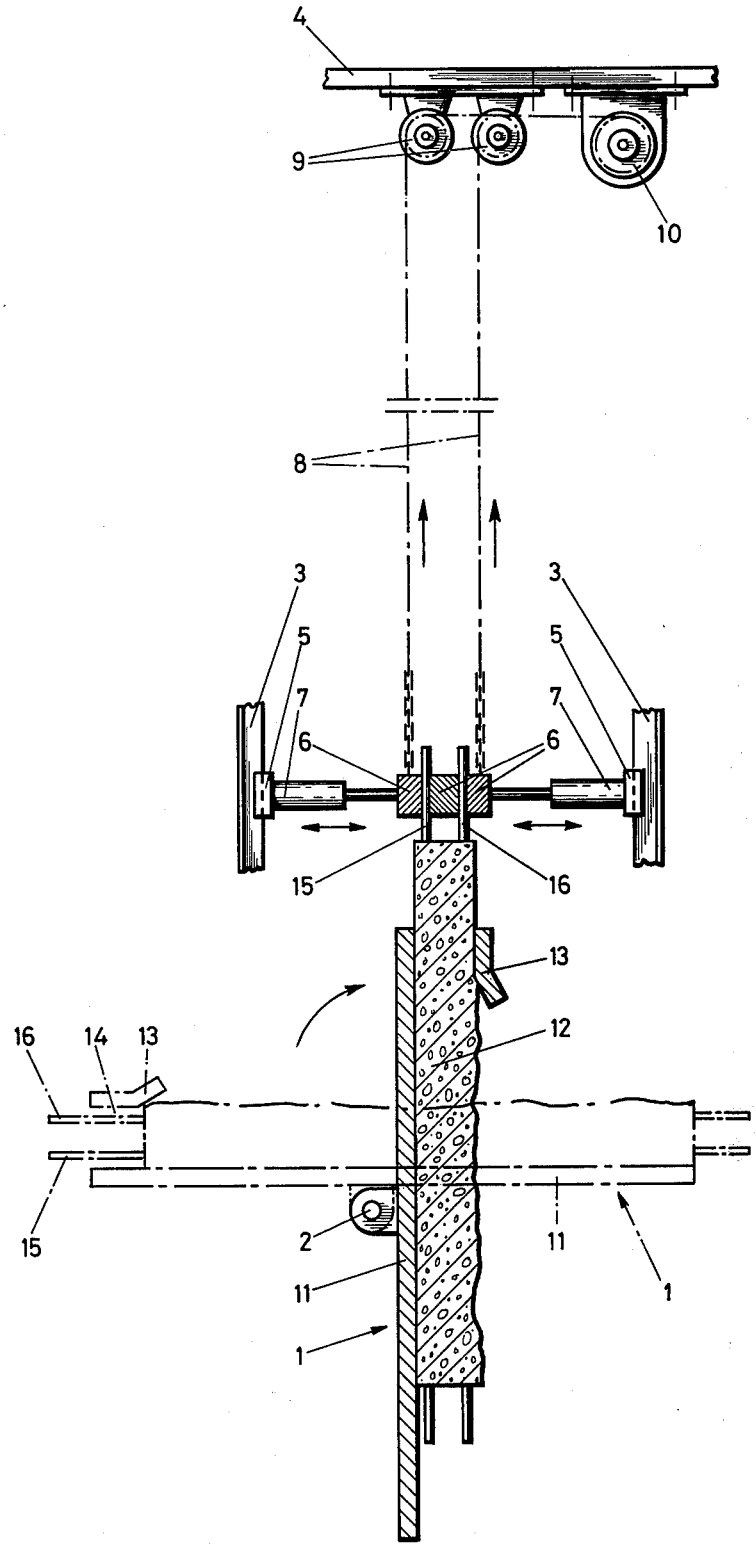
4
9
10
8
3
5
7
6
6
7
5
3
15
16
13
12
16
14
13
15
2
11
11
1
1

METHOD AND A DEVICE FOR PRODUCING A PLATE-LIKE STRUCTURAL ELEMENT

This invention relates in the first place to a method for producing a plate-like structural element from a hardening and initially paste-like material.

So far such a plate-like structural element — which may be used as a wall, as a division wall, whether self-sustaining or not, as a ceiling, as a floor plate and the like — is moulded in an entirely flat box-shaped mould and in this mould it is allowed to harden. The initial material consists for example of a carrier, such as a sand-cement mortar, and lighter or heavier additives, such as foamed polystyrene granules, gravel or the like. Since the hardening of such a material takes a few hours a somewhat economic production of such structural elements requires a great many of these expensive moulds. For the purpose of application it is preferred to make the structural elements as large as possible. A length of ± 3500 mm. for example is very suitable in practice. The width is for example in the magnitude of ± 600 mm.

It will be obvious that a mould having a base surface of ± 3500 × 600 mm., which moreover must be entirely flat, is very expensive.

The present invention aims at providing a method according to which the mould is not used during the hardening period so that consequently during the hardening time of a moulded structural element one can immediately use the mould again for moulding the next structural elements.

This is accomplished according to the invention in that one arranges in a vertical flat mould having a length, width, and thickness approximately corresponding to the length, width and thickness of the plate-like structural element at least one reinforcement of metal, synthetic resin or the like extending over mainly the entire surface of the mould and projecting at the upper side of the mould over a small length beyond said mould, said upper side comprising an opening defining the ultimate width and thickness of the structural element, that furthermore one fills the mould with the paste-like material, that one exerts pulling forces in an upward direction on the parts of the reinforcement projecting beyond the mould such that the entire reinforcement with the material adhering thereto can be pulled out of the mould and that one allows the structural element to harden outside the mould while being vertically suspended with its reinforcement.

Since filling the mould and withdrawing the reinforcement with the adhering mixture from the mould can be effected very rapidly — the withdrawing itself requires for example only ± 45 seconds — the mould is practically at once available for being refilled.

When arranging the reinforcement and filling the material it is preferred to keep the mould in a substantially horizontal position; prior to the action of the pulling forces on the reinforcement parts the mould is tilted into a vertical position.

It will be obvious that filling a mould arranged in the horizontal position is much simpler and the mould can be much simpler too. It is preferred for the mould to consist of a flat rectangular base plate and one end wall arranged perpendicularly thereto and comprising the afore-mentioned opening. Furthermore the mould is pivotal about a horizontal shaft.

The invention relates in the second place to a device for performing the method and also to a mould used in this method and to the structural element produced.

Further advantages and features of the invention will appear from the following description in which the invention will be further explained with reference to the diagrammatical drawing of the device preferably used.

The mould 1 is pivotally supported about a horizontal shaft 2 in the device.

During the filling operation the mould 1 is in a horizontal position as shown in dot and dash lines.

Above the mould 1 the device comprises a frame which mainly includes two vertical posts 3 interconnected at their upper ends by a cross-frame 4.

Along said vertical posts rollers 5 or the like may move with which clamping means 6 are connected that are adapted to be operated for example by pneumatic cylinders 7.

On the rollers 5 or the like and therefore on the clamping means 6 hoisting ropes 8 act which are adapted to be pulled up via guide pulleys 9 in the cross-frame 4 by a winch 10 likewise mounted on said cross-frame and to be lowered again after use.

In this preferred embodiment the mould 1 mainly comprises a base plate 11 having about the same surface or a somewhat larger surface than the structural element to be manufactured and being denoted by reference numeral 12, therefore for example 3500 mm. long and 600 mm. wide.

On said base plate 11 there is provided at the left hand end or right hand end an upright wall 13 of which in point of fact only the gap-like opening 14 is of importance for the invention. This gap-like opening 14 has a width and a thickness which are equal to those of the structural element 12 to be manufactured.

Since only the opening 14 is of importance this opening may also be formed by a rectangularly bent steel strip the inlet side of which is somewhat flared. The location of the opening 14 is established by the tilting direction of the mould 1.

On the base plate 11 there is first applied a thin layer of material consisting for example of a sand-cement mortar as a carrier and for example polystyrene granules as an additive. On top thereof a reinforcing layer 15 is arranged, for example in the form of a metal wire gauze, a perforated plate, a network composed of rods of synthetic resin or the like.

Subsequently material is again poured thereon. In case one wishes to arrange a second reinforcement 16 this should be done before the entire mould is filled up to a height which approximately corresponds to the desired thickness of the structural element to be manufactured. Otherwise the only reinforcement is arranged approximately in the middle.

It is essential that the reinforcement or reinforcements 15 and 16 projects or project over a certain distance through the opening 14 beyond the mould 1.

After the mould 1 has been filled it is tilted through 90° about the horizontal shaft 2 until the mould 1 is in a vertical position, see the position shown in full lines. In this position the mould is fixed.

Subsequently the clamping means 6 engage the reinforcement ends and the winch 10 is operated so that consequently the reinforcement 15 and 16 is pulled out of the mould 1 via the opening 14 which defines the cross-sectional shape of the structural element and is located in the upper end wall 13 of said mould 1. The reinforcement 15 and 16 exerts a sufficient adhesion on the material to allow the entire mould 1 to be emptied in this manner. The structural element 12 is now suspended, in not yet hardened condition, above the mould (not shown).

Now the structural element 12 can harden which takes a few hours. The mould 1 is tilted back and may be filled again.

Obviously one should see to it that after forming the second structural element there is sufficient space available for drawing said second structural element out of the mould. This may be realized in various way generally known in the technical field.

If one wishes to cover the structural element on one side with a wall cladding one may arrange on the base plate 11 of the mould 1 first a layer of wall tiles, a thin sheet of synthetic resin, wall paper or the like (not shown). Said wall cladding is drawn out of the mould along with the element and after hardening it is integral with the structural element. Recesses for electric wiring, sockets or other conduits can be formed by arranging cores in the mould.

It is obvious that all kinds of additives can be used. In case a sand-cement mortar as a carrier with foamed synthetic particles as an additive is used one obtains a so-called light weight concrete. Also ground domestic refuse may be used as an additive and likewise produces a concrete of relatively low specific gravity.

In the event of gravel being used as an additive one obtains normal concrete.

By selecting the correct material one may render the structural element fireproof.

It will be obvious that the sizes of length and width mentioned for the structural element to be moulded do not present any limitation for the invention. It is possible for example to select a larger width without any objection. The length may be varied too. However, when producing very long structural elements a very high device is required; for normal applications a length of ± 3500 mm is very suitable. The thickness may also be varied at choice. The thicker the structural element is, the greater the number of layers of reinforcement is that are required.

I claim:

1. A method for the manufacture of a plate-like structural element from a cement mortar, including the steps of providing a flat mould having a length, width and thickness approximately corresponding to the length, width and thickness of the plate-like structural element, providing at least one reinforcement of metal rods, a perforated plate or synthetic resin rods extending over substantially the entire surface of the mould and projecting beyond said mould at one side thereof, said one side comprising an opening defining the ultimate width and thickness of the structural element, arranging said mould in a horizontal position, filling the mould with said mortar, thereafter positioning the mould in a vertical position with said one side facing upwardly, exerting a pulling force in a vertically upward direction on the parts of the reinforcement projecting beyond the mould to pull the entire reinforcement with the mortar adhering thereto vertically out of the mould through said opening before said mortar hardens thereby exposing said mortar and removing external support from the sides of said element and allowing the structural element to harden outside the mould while being vertically suspended with its reinforcement, whereby said mould is ready for immediate reuse.

2. A method according to claim 1, characterized in that the mould consists substantially of a flat rectangular base plate and one end wall is arranged perpendicularly thereto and comprises the aforementioned opening.

3. A method according to claim 1, characterized in that first a layer of said mortar is arranged in the mould, then the reinforcement is arranged and subsequently the entire mould is filled with the mortar.

4. A method according to claim 3, characterized in that a plurality of layers of reinforcement are arranged in the mould.

5. A method according to claim 1, further characterized in first covering at least the horizontal base surface of the mould with a layer of wall covering so that said layer can also be pulled out from the mould and will constitute an integral part of the plate-like structural element.

* * * * *